US010895381B2

(12) United States Patent
Diehl et al.

(10) Patent No.: US 10,895,381 B2
(45) Date of Patent: Jan. 19, 2021

(54) MAGNETICALLY SECURED BURNER CAP

(71) Applicants: BSH Home Appliances Corporation, Irvine, CA (US); BSH Hausgeräte GmbH, Munich (DE)

(72) Inventors: Ronald Allen Diehl, LaFollette, TN (US); Josiah Fronckowiak, LaFollette, TN (US); Charles Gibson, Lafollette, TN (US)

(73) Assignees: BSH Home Appliance Corporation, Irvine, CA (US); BSH Hausgeräte GmbH, Munich (DE)

( * ) Notice: Subject to any disclaimer, the term of this patent is extended or adjusted under 35 U.S.C. 154(b) by 73 days.

(21) Appl. No.: 16/421,515

(22) Filed: May 24, 2019

(65) Prior Publication Data

US 2020/0370748 A1 Nov. 26, 2020

(51) Int. Cl.

| | |
|---|---|
| ***F23D 14/04*** | (2006.01) |
| ***F24C 3/08*** | (2006.01) |
| ***H05B 3/68*** | (2006.01) |

(52) U.S. Cl.

CPC ..... *F23D 14/04* (2013.01); *F24C 3/085* (2013.01); *H05B 3/685* (2013.01)

(58) Field of Classification Search

CPC ..... F24C 3/085

See application file for complete search history.

(56) References Cited

U.S. PATENT DOCUMENTS

| | | | | |
|---|---|---|---|---|
| 3,119,003 | A | 1/1964 | Duke, Jr. | |
| 6,851,420 | B2 * | 2/2005 | Jennings | F23D 14/045 126/39 R |
| 9,217,571 | B1 * | 12/2015 | Frost | F24C 3/08 |
| 2003/0087214 | A1 * | 5/2003 | Welton | F24C 3/085 431/286 |

FOREIGN PATENT DOCUMENTS

DE 102007006044 A1 8/2008

* cited by examiner

*Primary Examiner* — David J Laux

(74) *Attorney, Agent, or Firm* — Michael E. Tschupp; Andre Pallapies; Brandon G. Braun

(57) ABSTRACT

A domestic gas cooking appliance for heating a food item is provided. The domestic cooking appliance includes a top sheet; a burner body on the top sheet, the burner body having an upwardly extending riser pin; a gas supply line that supplies gas to the burner body; and a burner cap positioned above the burner body and resting on the riser pin such that a pin receiving area contacts the riser pin. One of the riser pin and the pin receiving area comprises a magnet, and the other of the riser pin and the pin receiving area comprises a ferrous material.

20 Claims, 7 Drawing Sheets

MAGNETICALLY SECURED BURNER CAP

FIELD OF THE INVENTION

The invention is directed to a domestic cooking appliance. More particularly, embodiments of the invention are directed to a burner cap for a gas burner where the burner cap is held in position by magnets.

An example of an application for the invention is a domestic kitchen gas cooktop having a gas burner with a burner cap having magnets formed in the burner cap.

BACKGROUND OF THE INVENTION

Some modern domestic kitchens include cooking appliances such as cooktops and ranges that have gas burners. Many gas burners have a burner body and a burner cap that loosely sits on the burner body. The combination of the burner cap and the burner body forms a plurality of gas outlets in the burner through which gas or a gas/air mixture exits the burner to be burned. In many gas burners, the burner cap fits loosely on the burner body such that it can easily be moved by, for example, contact by the user or the slamming of a cabinet or oven door.

Applicants recognized an improvement to the above arrangement and implement that improvement in embodiments of the invention.

SUMMARY

The invention achieves the benefit of providing a domestic cooking appliance that portrays a high level of quality and avoids unwanted noise and potential damage by magnetically securing a burner cap to a burner body.

Particular embodiments of the invention are directed to a domestic gas cooking appliance for heating a food item, including a top sheet; a burner body on the top sheet, the burner body having an upwardly extending riser pin; a gas supply line that supplies gas to the burner body; and a burner cap positioned above the burner body and resting on the riser pin such that a pin receiving area contacts the riser pin. One of the riser pin and the pin receiving area comprises a magnet, and the other of the riser pin and the pin receiving area comprises a ferrous material.

In some embodiments, the riser pin includes a pin body and a pin cap, the pin cap is attached to the pin body and forms an upper region of the pin body, the pin body and the burner body are a same material, and the pin cap is the ferrous material.

In some embodiments, the riser pin comprises a pin body and a pin cap, the pin cap is attached to the pin body and forms an upper region of the pin body, the pin body and the burner body are a same material, and the pin cap comprises the magnet.

Other embodiments of the invention are directed to a gas burner for a domestic gas cooking appliance. The gas burner includes a burner body having an upwardly extending riser pin; and a burner cap positioned above the burner body and resting on the riser pin such that a post receiving area contacts the riser pin. One of the riser pin and the post receiving area comprises a magnet, and the other of the riser pin and the post receiving area comprises a ferrous material.

In some embodiments, the burner body comprises a plurality of the riser pin, and the burner cap further comprises a locating feature that interacts with the plurality of riser pins to positively locate the burner cap relative to the burner body in a direction perpendicular to an axial direction of the riser pins.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a domestic cooktop, range, or other cooking appliance.

Figure 1:
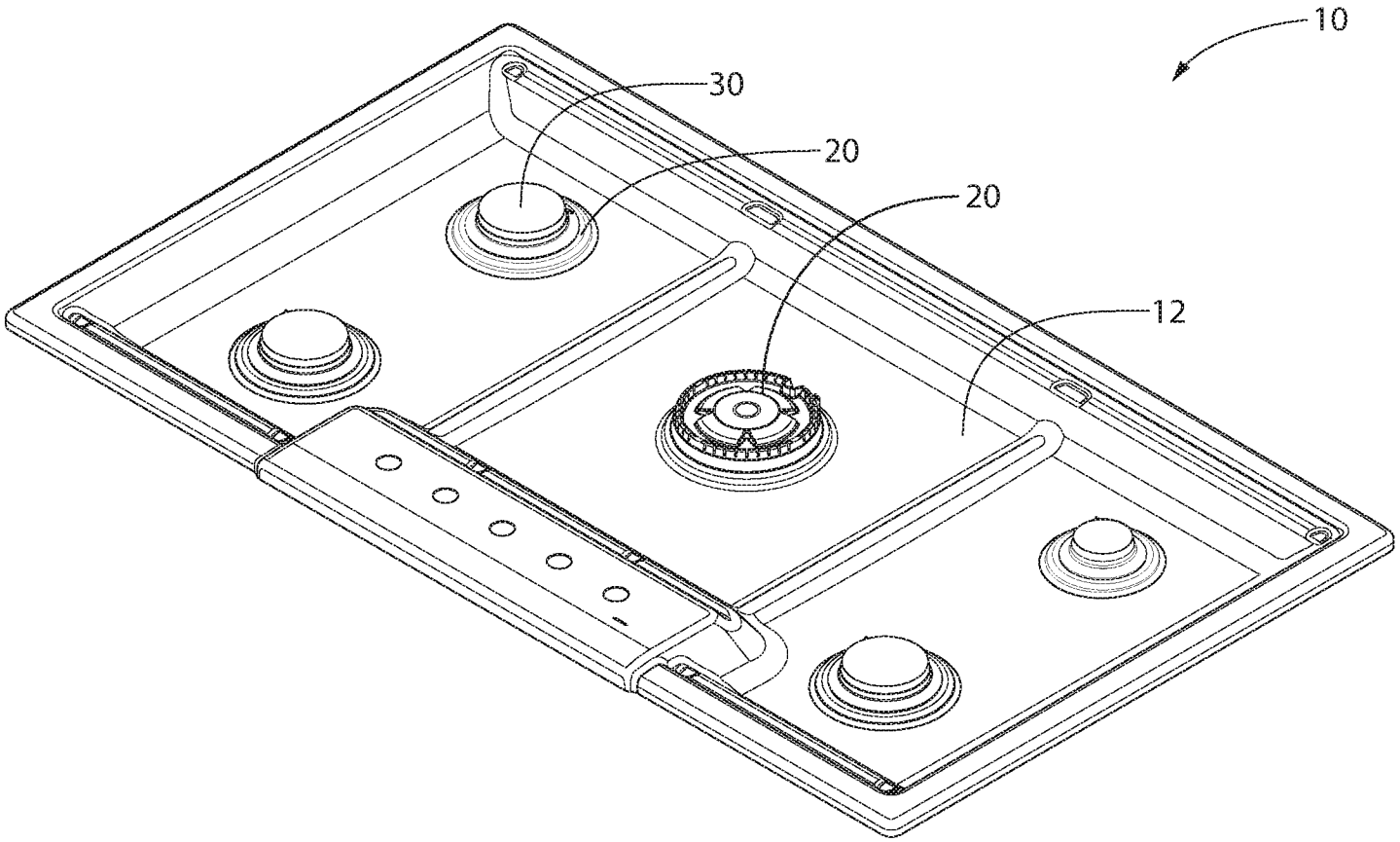
FIG. 1 is a perspective schematic view of an exemplary appliance in accordance with embodiments of the invention.

FIG. 1 shows an example of a domestic kitchen appliance 10 having a top sheet 12 and five burners positioned on top sheet 12. In this example, each burner has a burner body 20 and a burner cap 30. As explained in more detail below, burner cap 30 sits on burner body 20 and is an integral part of the chamber that directs gas to a plurality of outlets in the burner at which the gas is ignited and burned.

Figure 2:
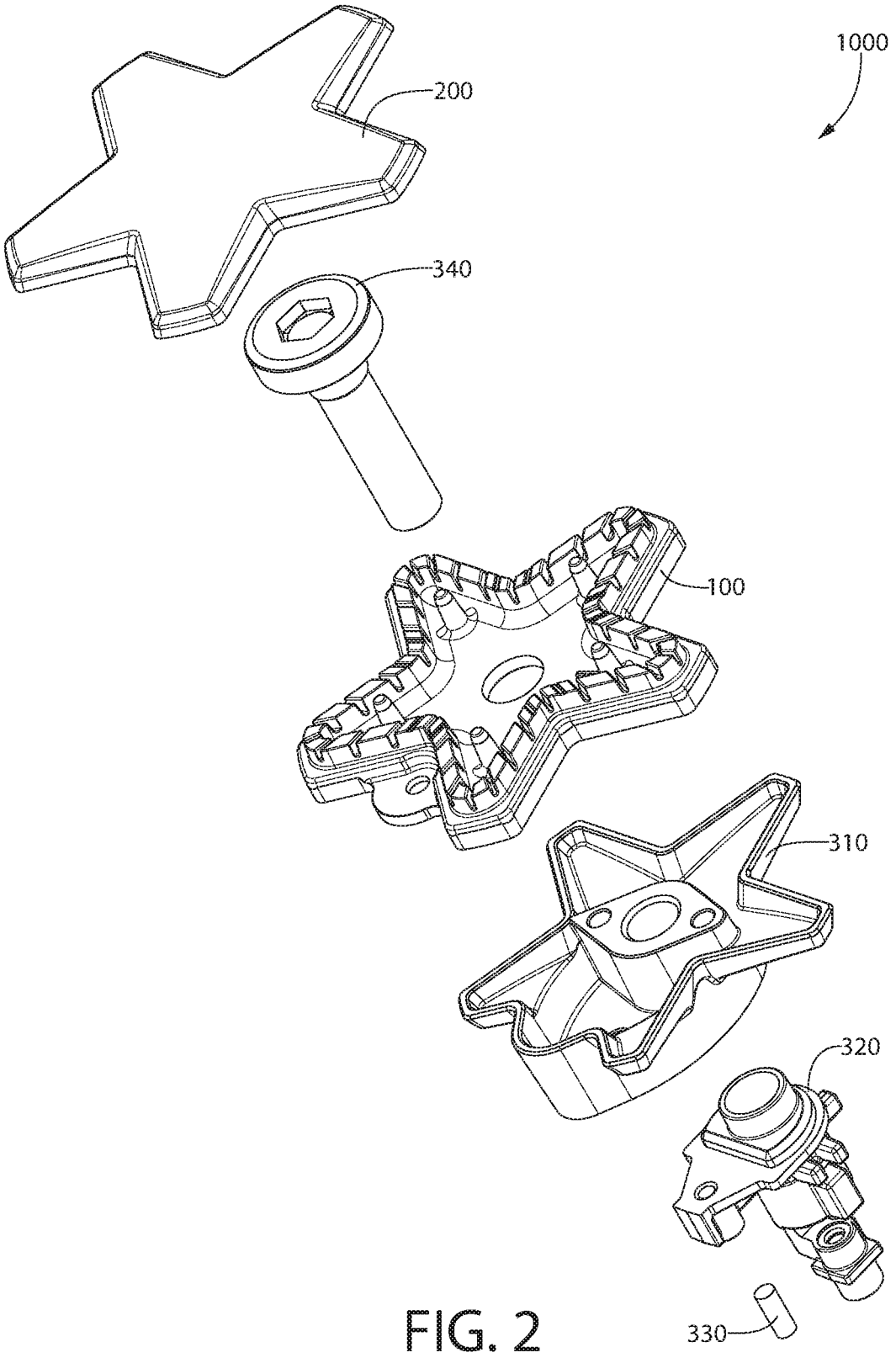
FIG. 2 is an exploded perspective view of a gas burner in accordance with embodiments of the invention.

FIG. 2 shows an example of a gas burner 1000 in accordance with embodiments of the invention. Burner 1000, in this example, has a gas valve 320, a burner base 310, and a burner body 100 held in place by a gas passage 340. Gas and/or a gas/air mixture is supplied to gas valve 320 by a gas supply line (not shown). An igniter 330 is also provided to ignite the gas/air mixture when activated by controls (not shown). Also shown in FIG. 2 is a burner cap 200 that rests on burner body 100 when burner 1000 is in an assembled state.

Figure 3:
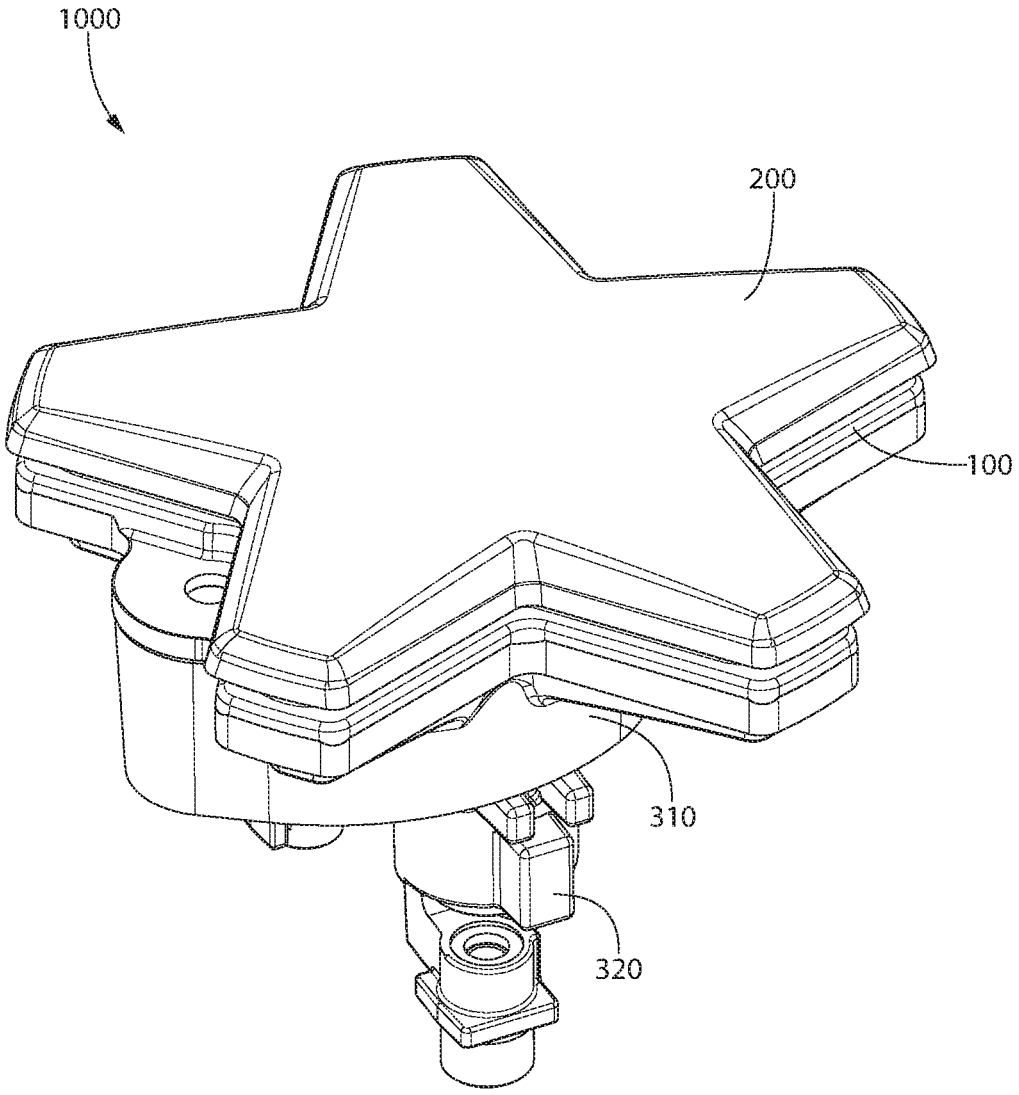
FIG. 3 is a assembled perspective view of the gas burner shown in FIG. 2.
Figure 4:
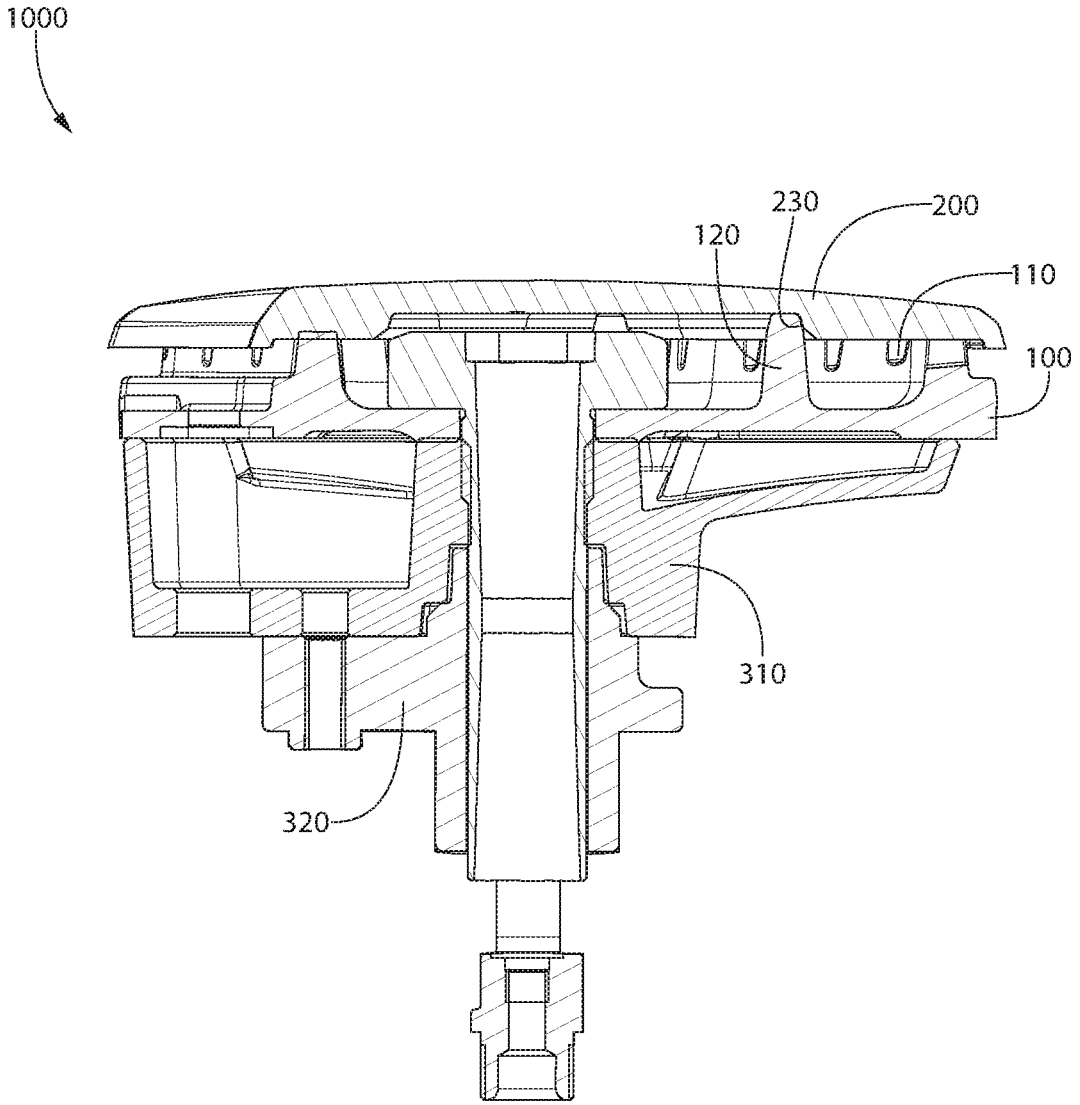
FIG. 4 is a sectional view of the gas burner shown in FIGS. 2 and 3.

FIG. 3 shows burner 1000 in an assembled state in which burner cap 200 is in position on top of burner body 100. FIG. 4 is a sectional view of burner 1000 and shows burner cap 200 resting on a plurality of riser pins 120 (discussed in more detail below) of burner body 100. Also shown in FIG. 4 are a plurality of gas outlets 110 through which gas or a gas/air mixture exits burner 1000 to be ignited and burned to heat a cooking utensil or other vessel. In this embodiment, riser pins 120 are located in pin receiving areas 230 in burner cap 200. As discussed above, some gas burners have a burner cap that loosely fits on the burner body. This can lead to the burner cap being moved by being contacted by a cooking utensil or other object. A loosely fitting burner cap can also be moved by a shock such as a cabinet door slamming, the oven door slamming in the case of a range, the cooktop/range being hit by an object, or any other dislocating force.

A loosely fitting burner cap that can be dislodged from its correct position is not ideal because when a burner cap is not properly centered the gas outlets may not be ideally formed Improperly formed gas outlets can result in decreased burner efficiency and/or reduced uniformity of the flame created by the burner. In addition, a burner cap that rattles and/or easily moves can portray a low quality of product to the user or potential buyer. Further, a burner cap that is dislodged from the burner base can impact the top sheet and cause unsightly damage to the top sheet, the burner body, and/or the burner cap.

Figure 5:
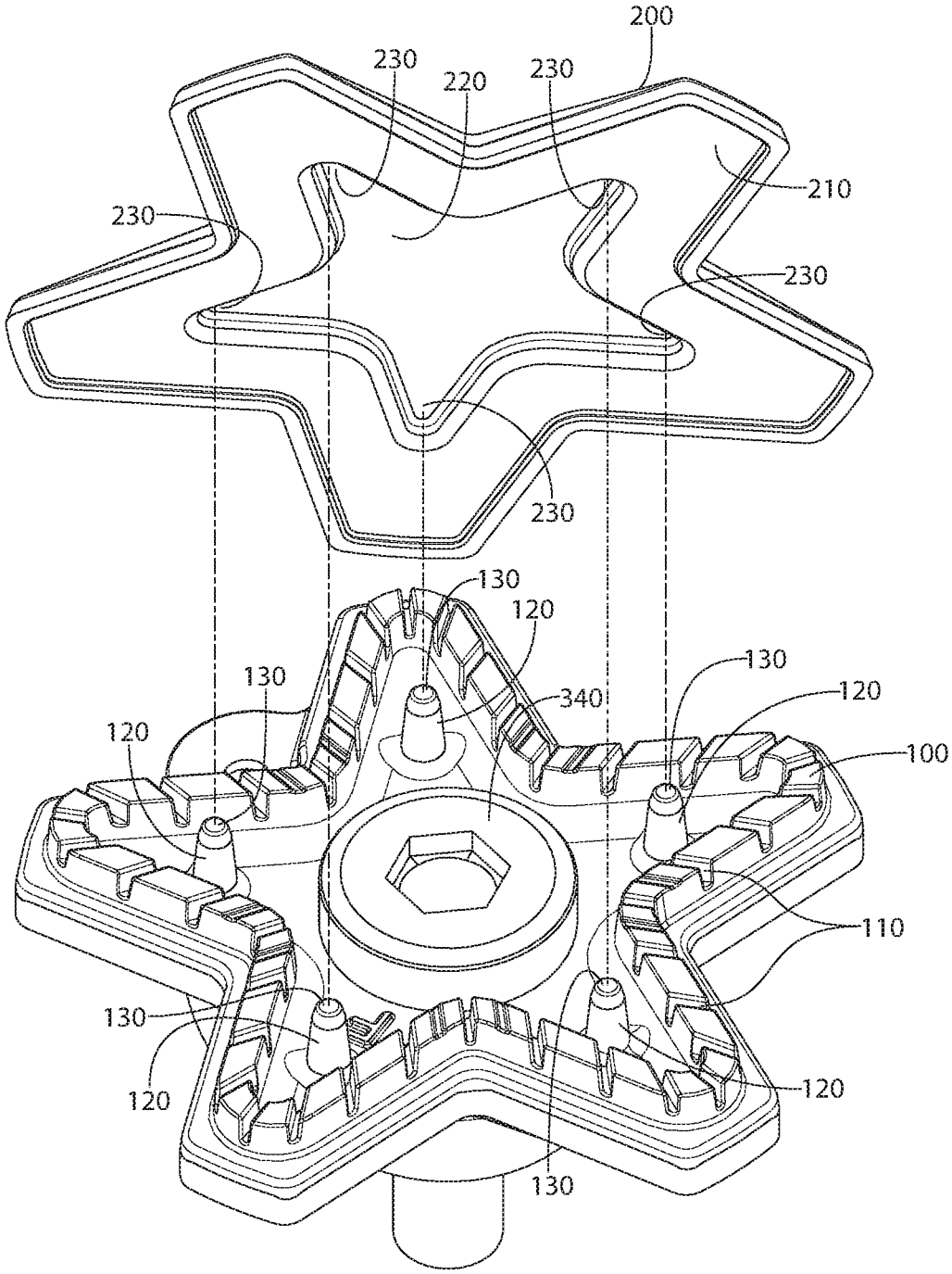
FIG. 5 is a perspective view of the gas burner shown in FIGS. 2-4 with the burner cap removed.

FIG. 5 shows burner cap 200 positioned above burner body 100 to illustrates various parts of the invention. Burner cap 200 has an underside 210 that, in this example, has a recess 220. Recess 220 is, in this example, shaped to form five pin receiving areas 230. Each pin receiving area 230 is shaped to receive one of five riser pins 120. In this example, the relative positions of riser pins 120 and pin receiving areas 230 are such that burner cap 200 is positioned by each riser pin 120 contacting the walls of recess 220 at a respective one of pin receiving areas 230. In other examples, not all of riser pins 120 contact the walls of recess 220 at a respective one of pin receiving areas 230 at the same time.

In some examples, burner cap 200 and burner body 100 are dissimilar metals and, as a result, can expand in different amounts when heated. In some embodiments where burner cap 200 expands more when heated than does burner body 100, each riser pin 120 contacts the walls of recess 220 at a respective one of pin receiving areas 230 at the same time when the burner is a room temperature. This configuration results in a burner cap that is positively located in the horizontal direction when at room temperature, but could still be dislodged absent another feature of the invention. In some embodiments where burner cap 200 and burner body 100 expand the same amount, each riser pin 120 contacts the walls of recess 220 at a respective one of pin receiving areas 230 at the same time. In some embodiments, less than all of the riser pins 120 contact the walls of recess 220 at a respective one of pin receiving areas 230 at any one time.

FIG. 5 shows an example of the invention in which each riser pin 120 has an end section 130 that includes a magnet such as, for example, a high temperature neodymium permanent magnet. In this example, burner cap 200 is made of a ferrous material. The magnetic attraction between magnetic end sections 130 and ferrous burner cap 200 results in burner cap 200 remaining in the desired position on burner body 100 even when subjected to a jarring or dislocating force. In one embodiment, five N30AH neodymium magnets that can withstand temperatures in excess of 450 degrees Fahrenheit are used. In some embodiments, less than all of riser pins 120 or end sections 130 include a magnet. In some examples having five riser pins 120, one, two, three, four, or five riser pins 120 (or end sections 130) include a magnet. In one embodiment, three riser pins 120 or end sections 130 include a magnet and two do not, and the three riser pins 120 or end sections 130 that have magnets are not all located next to each other. This configuration provides a triangle formation of the magnetic attraction that will keep burner cap 200 from becoming dislodged from burner body 100.

In some embodiments, particularly when burner cap 200 is not a ferrous material, a piece of ferrous material is attached to burner cap 200 at one or more of pin receiving areas 230. One or more pin receiving areas 230 can include a piece of ferrous material that is surface mounted, inset, or partially inset in burner cap 200. In some of these embodiments, the formation of the underside of burner cap 200 may need to include protrusions or recesses at pin receiving areas without added ferrous material in order to provide proper contact with riser pins 120.

End sections 130 can be formed into riser pins 120 when burner body 100 is being made, or end sections 130 can be a retro-fitted attachment to the ends of riser pins 120. For example, each end section 130 can be a metal cup with a magnet on its top side and can be pressed on to a riser pin 120 and held in place by a friction fit. In other examples, end sections 130 can be welded, glued, or otherwise attached to riser pins 120.

Figure 6:
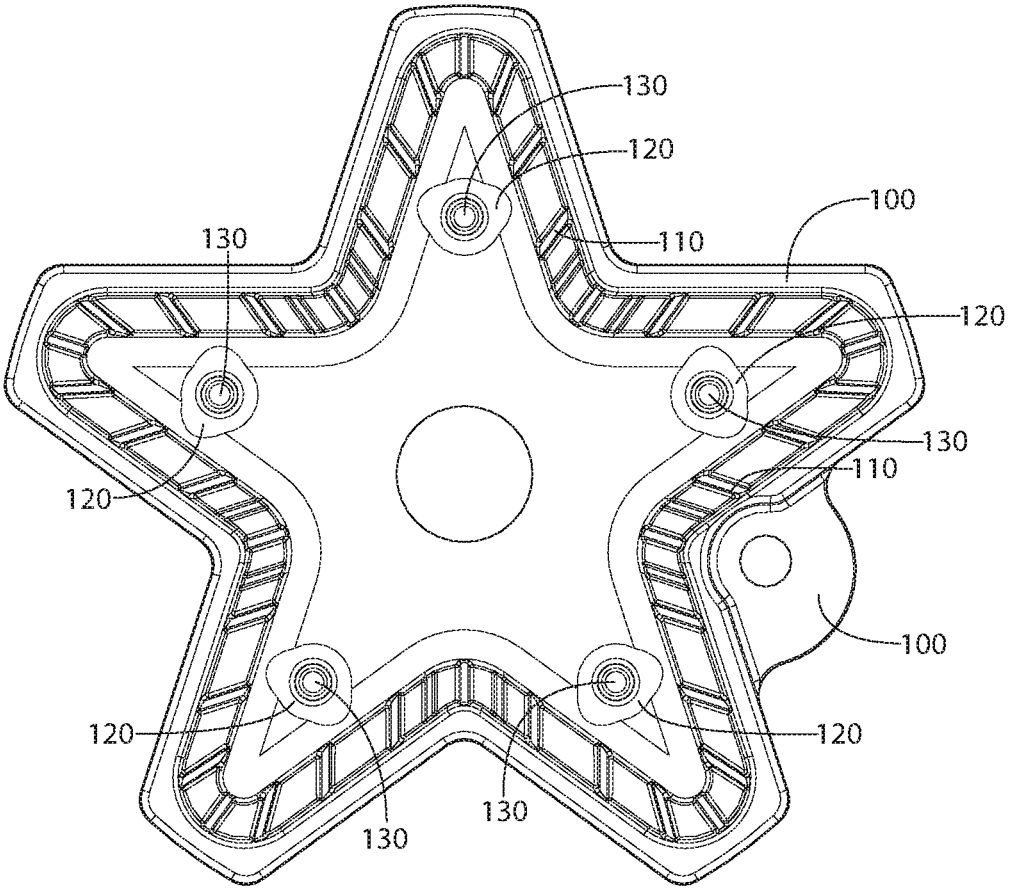
FIG. 6 is a top view of an exemplary burner body in accordance with embodiments of the invention.
Figure 7:
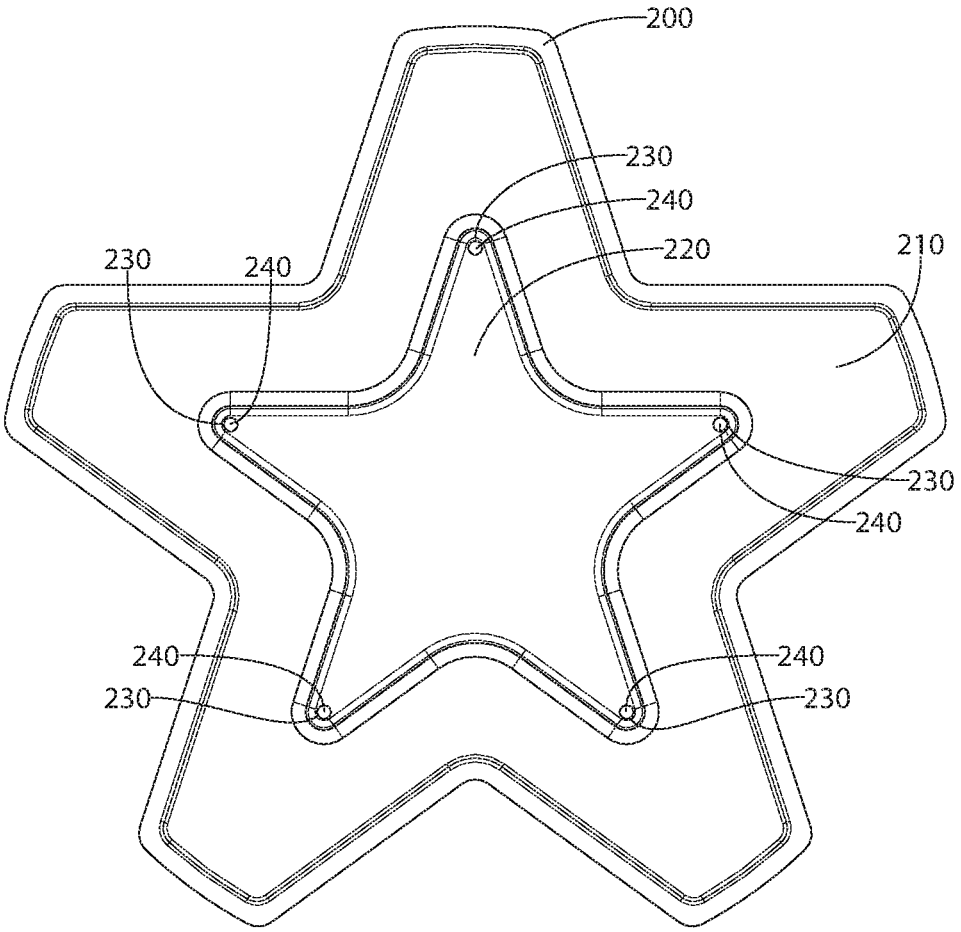
FIG. 7 is a bottom view of an exemplary burner cap in accordance with embodiments of the invention.

FIGS. 6 and 7 shows an example of the invention in which the magnetic material is a part of burner cap 200 and the ferrous material is a part of burner body 100. As shown in FIG. 7, burner cap 200 has a magnet 240 attached to burner cap 200 at each pin receiving area 230. These locations correspond to riser pins 120 shown in FIG. 6. In one embodiment, five N30AH neodymium magnets that can withstand temperatures in excess of 450 degrees Fahrenheit are used. In some embodiments, less than all of pin receiving locations 230 include a magnet. In some examples having five riser pins 120, one, two, three, four, or five pin receiving locations 230 include a magnet 240. In one embodiment, three pin receiving locations 230 include a magnet 240 and two do not, and the three pin receiving locations with magnets 240 are not all located next to each other. This configuration provides a triangle formation of the magnetic attraction that will keep burner cap 200 from becoming dislodged from burner body 100. Magnets 240 can be surface mounted, inset, or partially inset in burner cap 200.

In some embodiments where one or more pin receiving locations 230 include magnets, one or more of riser pins 120 include a ferrous material. In some embodiments, all five riser pins 120 are ferrous pins that are pressed into burner body 100. In other embodiments, riser pins 120 are welded, glued, or otherwise attached to burner body 100. In some embodiments, one, two, three, four, or five riser pins 120 are ferrous material. In some embodiments, end sections 130 of riser pins 120 are ferrous material. End sections 130 can be formed into riser pins 120 when burner body 100 is being made, or end sections 130 can be a retro-fitted attachment to the ends of riser pins 120. For example, each end section 130 can be a metal cup that is ferrous material or includes ferrous material on its top side and can be pressed on to a riser pin 120 and held in place by a friction fit. In other examples, end sections 130 can be welded, glued, or otherwise attached to riser pins 120.

In one embodiment, three riser pins 120 or end sections 130 include ferrous material and two do not, and the three riser pins 120 or end sections 130 that include ferrous material are not all located next to each other. This configuration provides a triangle formation of the magnetic attraction that will keep burner cap 200 from becoming dislodged from burner body 100.

When gas burners are designed, the impact on gas flow of the structural features of the burner body and burner cap are taken into consideration. Embodiments of the invention do not materially alter the of the shape of the areas through which gas and/or gas/air mixture travel through the burner and, therefore, do not require the re-developing of flow profiles for a given burner design. In addition, by providing the magnetic material or the ferrous material in riser pins 120, impact of the invention on the gas or gas/air mixture flow is minimized or eliminated.

While examples having five riser pins 120 are used to describe embodiments of the invention, it is understood that other examples have fewer or more than five riser pins 120. While examples having five pin receiving areas 230 are used to describe embodiments of the invention, it is understood that other examples have fewer or more than five pin receiving areas 230.

While ferrous riser pins are used in some of the above examples, it is noted that other examples of the invention use ferrous screws or other fasteners that fasten burner body 100 to the appliance as the ferrous material to which the magnets are attracted. In addition, while some of the embodiments above provide magnets that contact the ferrous material, other embodiments provide a gap (either filled by another material or an air gap) between some or all of the magnet and the ferrous material.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A gas burner for a domestic gas cooking appliance; the gas burner comprising:

a burner body having an upwardly extending riser pin; and a burner cap positioned above the burner body and resting on the riser pin such that a post receiving area contacts the riser pin, wherein one of the riser pin and the post receiving area comprises a magnet, and the other of the riser pin and the post receiving area comprises a ferrous material.

2. The gas burner of claim 1, wherein the burner cap further comprises a locating feature that interacts with the riser pin to positively locate the burner cap relative to the burner body in a direction perpendicular to an axial direction of the riser pin.

3. The gas burner of claim 2, wherein the burner body comprises a plurality of the riser pin, and the burner cap further comprises a locating feature that interacts with the plurality of riser pins to positively locate the burner cap relative to the burner body in a direction perpendicular to an axial direction of the riser pins.

4. The gas burner of claim 1, wherein the riser pin comprises the ferrous material.

5. The gas burner of claim 4, wherein the riser pin comprises a pin body and a pin cap, the pin cap is attached to the pin body and forms an upper region of the pin body, the pin body and the burner body are a same material, and the pin cap is the ferrous material.

6. The gas burner of claim 1, wherein the burner body comprises a plurality of the riser pin, and the burner cap is supported by only the plurality of riser pins.

7. The gas burner of claim 1, wherein the pin receiving area comprises the ferrous material.

8. The gas burner of claim 7, wherein the burner body comprises a plurality of the riser pin, and the burner cap further comprises a locating feature that interacts with the plurality of riser pins to positively locate the burner cap relative to the burner body in a direction perpendicular to an axial direction of the riser pins.

9. A domestic gas cooking appliance for heating a food item, comprising:

a top sheet;

a burner body on the top sheet, the burner body having an upwardly extending riser pin;

a gas supply line that supplies gas to the burner body; and a burner cap positioned above the burner body and resting on the riser pin such that a pin receiving area contacts the riser pin, wherein one of the riser pin and the pin receiving area comprises a magnet, and the other of the riser pin and the pin receiving area comprises a ferrous material.

10. The domestic gas cooking appliance of claim 9, wherein the riser pin comprises the ferrous material.

11. The domestic gas cooking appliance of claim 10, wherein the burner body and the riser pin are different materials.

12. The domestic gas cooking appliance of claim 11, wherein the burner body and the burner cap are dissimilar metals.

13. The domestic gas cooking appliance of claim 10, wherein the riser pin comprises a pin body and a pin cap, the pin cap is attached to the pin body and forms an upper region of the pin body, the pin body and the burner body are a same material, and the pin cap is the ferrous material.

14. The domestic gas cooking appliance of claim 13, wherein the domestic gas cooking appliance comprises a plurality of the riser pin, and the burner cap is supported by only the plurality of riser pins.

15. The domestic gas cooking appliance of claim 9, wherein the domestic gas cooking appliance comprises a plurality of the riser pin, and the burner cap is supported by only the plurality of riser pins.

16. The domestic gas cooking appliance of claim 9, wherein the magnet is a magnet that can function as a magnet at 450 degrees Fahrenheit.

17. The domestic gas cooking appliance of claim 9, wherein the pin receiving area comprises the ferrous material.

18. The domestic gas cooking appliance of claim 17, wherein the riser pin comprises a pin body and a pin cap, the pin cap is attached to the pin body and forms an upper region of the pin body, the pin body and the burner body are a same material, and the pin cap comprises the magnet.

19. The domestic gas cooking appliance of claim 9, wherein the burner cap further comprises a locating feature that interacts with the riser pin to positively locate the burner cap relative to the burner body in a direction perpendicular to an axial direction of the riser pin.

20. The domestic gas cooking appliance of claim 9, wherein the domestic gas cooking appliance comprises a plurality of the riser pin, and the burner cap further comprises a locating feature that interacts with the plurality of riser pins to positively locate the burner cap relative to the burner body in a direction perpendicular to an axial direction of the riser pins.

* * * * *